United States Patent [19]

Del Castillo Von Haucke

[11] Patent Number: 4,928,465

[45] Date of Patent: May 29, 1990

[54] MODULAR PRIVACY SCREEN ASSEMBLIES

[76] Inventor: Juan M. Del Castillo Von Haucke, Salamanca No. 34, 20 Piso, Mexico, Mexico

[21] Appl. No.: 334,528

[22] Filed: Apr. 7, 1989

[51] Int. Cl.[5] ..... E04B 2/74

[52] U.S. Cl. ..... 52/239; 52/243; 52/780; 160/135

[58] Field of Search ..... 52/239, 243, 780, 774, 52/243.1; 160/135

[56] References Cited

U.S. PATENT DOCUMENTS 3,327,440 6/1967 Watkins ..... 52/239

4,493,174 1/1985 Arens ..... 52/243

FOREIGN PATENT DOCUMENTS 1271108 7/1961 France ..... 52/239

*Primary Examiner*—James L. Ridgill, Jr.

*Attorney, Agent, or Firm*—Karl W. Flocks

[57] ABSTRACT

Modular privacy screen assemblies having one or more panels and vertical consolidating or joining members of channel formation mated to the panels by side openings or slots on the panels extending outwardly and downwardly and engaging upwardly and outwardly extending supporting surfaces on said consolidating or joining members.

1 Claim, 3 Drawing Sheets

MODULAR PRIVACY SCREEN ASSEMBLIES

FIELD OF INVENTION

This invention relates to modular assemblies of privacy screens or partitions and more particularly to assemblies involving one or more panels and consolidating or joining elements or stiles which may take the form of an end consolidating element such as a stile or an intermediate linear joining element or an angular joining element or a joining element in the form of a cross or a joining element in the form of a "T".

BACKGROUND OF THE INVENTION

Prior to the instant invention it has been proposed to use privacy panels assembled in linear form including stiles or rails and stiles and in cublicle form; however, such prior constructions and formations utilized relatively complex assembly means including nuts and bolts, screws, and battens, and prior constructions have even included soldering and welding processes. Such prior constructions have been relatively expensive, lacking in versatility, and complicated in assembly, generally requiring laborious and time-consuming effort.

OBJECTS OF THE INVENTION

It is an object of the instant invention to provide a novel screen assembly useful as a protective barrier or partition which will be of simple construction, easy to assemble, and relatively economical.

It is a further object of the instant invention to provide a novel modular screen assembly to serve as a space divider which is made up of panels and stiles or consolidating or joining elements and which can be assembled with ease.

It is still another object of the invention to provide a novel modular screen assembly which can be readily disassembled and readily re-assembled with versatility of configuration and superior functional characteristics.

Other objects and the nature of the invention will become readily apparent from the following description and the related drawings.

DETAILED DESCRIPTION OF THE INVENTION

Figure 2:
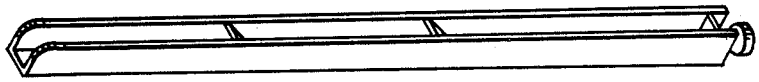
FIG. 2 is a view in perspective of an end consolidating element or stile.
Figure 1:
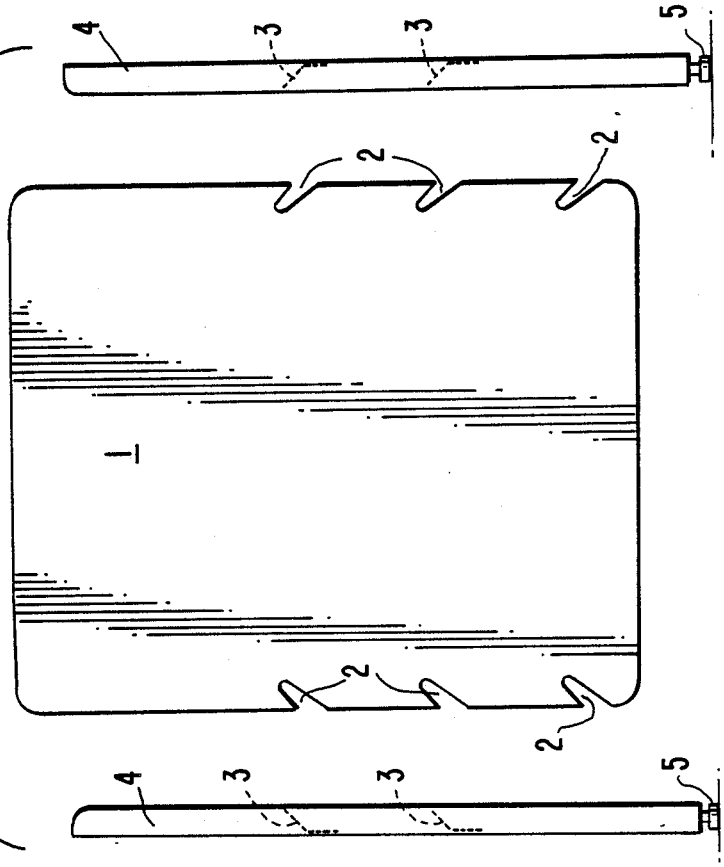
FIG. 1 is an exploded front elevation of one panel and two end consolidating elements or stiles.

Referring to FIGS. 1 and 2, the panel 1 is formed with a series of diagonal openings or slots 2. These slots 2 or openings 2 extend downwardly and outwardly at each side. As illustrated in FIG. 1, each side of the panel 1 is formed with three slots 2. However, the end consolidating members 4, also shown in perspective in FIG. 2, are each provided with two corresponding angular supporting elements 3 and so it will be understood that when the upper two slots or openings are associated with the two supports 3 of each end consolidating member or stile, then the panel 1 will be in its normal or lower position. However, when the lowermost slot or opening 2 in the panel 1 is associated with the lowermost support 3 in the end consolidating member and the middle slot or opening 2 is associated with the upper support 3 of the end consolidating member of stile 4, then the panel 1 will be in its uppermost position to provide privacy at a higher level.

Thus it will be understood that the slots on diagonal openings 2 which extend downwardly and outwardly provide panel edge formations which fit on and align with supports 3 of the elements 4 to effect a finished structure at the sides. Taking advantage of the weight of the panel 1 the joint between the panel and the consolidating or joining member or stile is stable, strong, immovable without a lifting motion.

At the foot or base of the consolidating elements 4 there is arranged an element 5 adapted to contact the floor and which may include a conventional height adjusting formation. This element 5 may take the form of a hemisphere.

Figure 3:
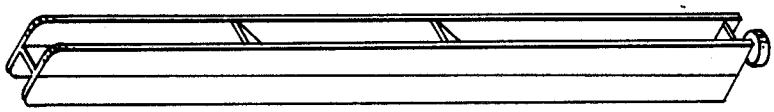
FIG. 3 is a view in perspective of a consolidating or joining element useful in the assembly of panels in linear formation so that when assembled the panels of the assembly are in the same plane.

Referring to FIG. 3, there is illustrated the consolidating element 4' useful in assembling panels 1 in linear fashion.

Figure 4:
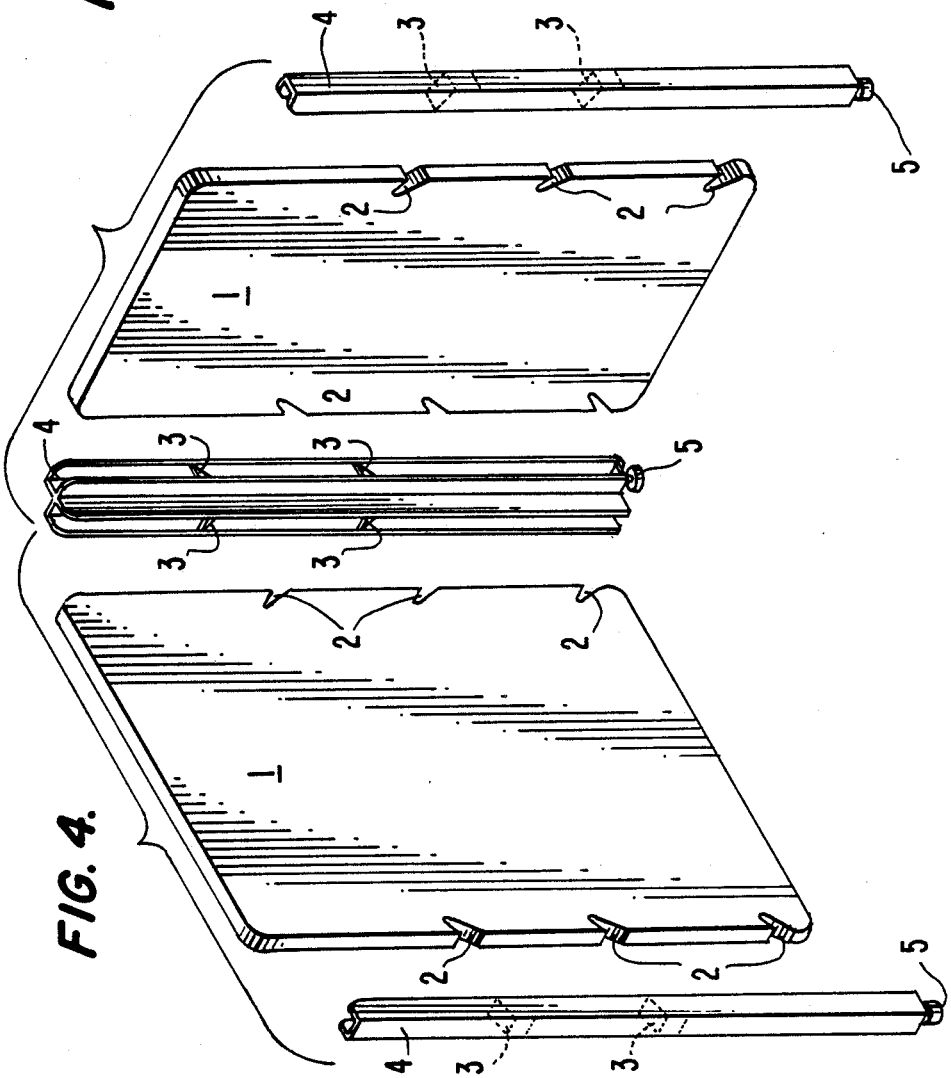
FIG. 4 is an exploded modular screen assembly showing a central angular consolidating or joining element, adjacent panels, and two end consolidating elements.

Referring to FIG. 4, the consolidating or joining element 4'' is utilized to assemble two adjacent panels 1 at right angles.

Figure 5:
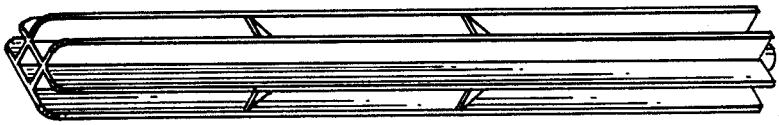
FIG. 5 is a view in perspective of consolidating or joining elements useful to effect a modular screen assembly of T-formation.

Referring to FIG. 5, the consolidating element 4''' is useful in the assembly of a screen or privacy structure or "T" formation.

Figure 6:
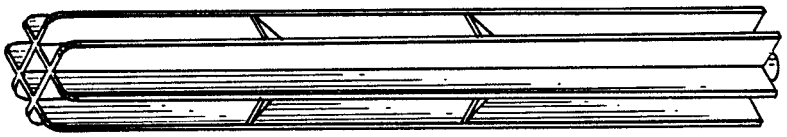
FIG. 6 is a view in perspective of a consolidating or joining element useful to effect a modular screen assembly in the form of a cross.

Referring to FIG. 6, the consolidating or joining element 4'''' is useful in assembling a modular screen formation in the arrangement of a cross.

Figure 7:
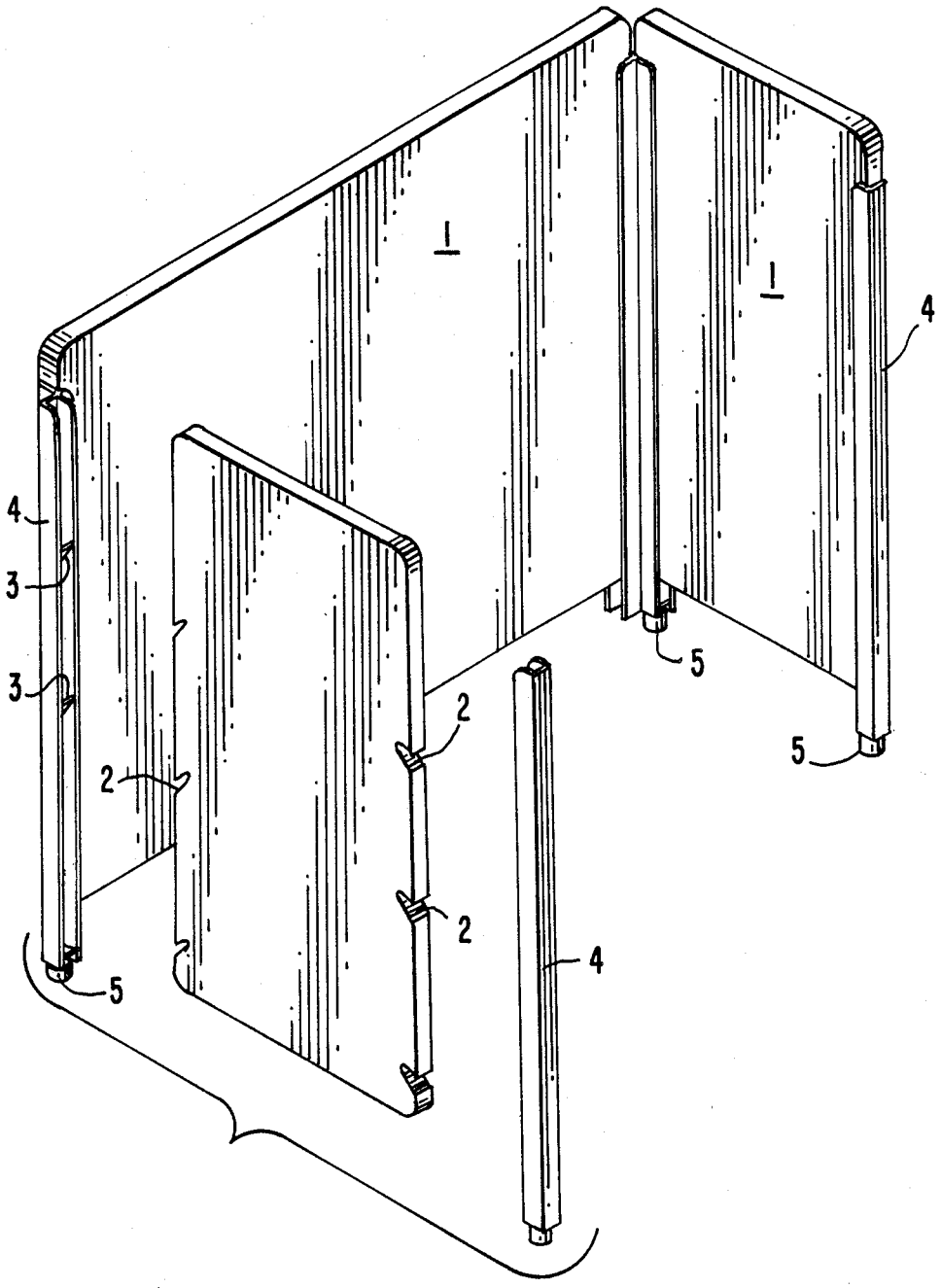
FIG. 7 is a view in perspective, partially exploded, illustrating three panels, two angular consolidating elements or stiles. This formation results in an office type cubicle.

Referring to FIG. 7, the cubicle illustrated utilizes two right angle consolidating members 4'', two end consolidating members 4 and three panels 1.

It will now be understood, and it is apparent, that the novel modular screen assemblies described have great utility, may be readily assembled and readily disassembled without the use of conventional joining expedients, such as nuts and bolts, screws, or other fixtures and processes and that the structures described eliminate critical labor.

What has been described are preferred embodiments. Modifications and substitutions of equivalents may be made without departing from the spirit of the invention.

What is claimed is:

1. Modular privacy screen assemblies comprising vertical stiles and plane panels, said vertical stiles including at least one longitudinally extending channel within which and extending horizontally and transversely thereof are two vertically spaced supporting elements, the upper supporting element being vertically spaced below the top of the stile with which it is associated and the lower supporting member being vertically spaced from and above the bottom of the stile with which it is associated, each of said plane panels having a left side and a right side, a top margin and a bottom margin, each of said plane panel sides being formed with three vertically spaced, inwardly and upwardly extending slots, the lower slot on each panel side being relatively close to its corresponding panel bottom, and the upper slot being spaced below the panel top for a greater distance than the distance between the uppermost slot and the second or middle slot, the distance between the second or middle slot and the lowermost slot being equal to the distance between the uppermost slot and the middle slot, whereby when the uppermost slots and the middle slots are engaged with the two supporting members associated with the stiles the panel will be in its lowermost position, and when the middle slots and the lowermost slots are associated with the two supporting members in each stile the panel will be in its uppermost position and the panel top will be level.

* * * * *